US005385617A

United States Patent [19]

Hamada et al.

[11] Patent Number: 5,385,617

[45] Date of Patent: Jan. 31, 1995

[54] ULTRALOW YIELD STRENGTH STEEL

[75] Inventors: Kazushi Hamada; Kazushige Tokuno, both of Futtsu, Japan

[73] Assignee: Nippon Steel Corporation, Tokyo, Japan

[21] Appl. No.: 186,723

[22] Filed: Jan. 26, 1994

[30] Foreign Application Priority Data

Feb. 9, 1993 [JP] Japan ..... 5-020898

[51] Int. Cl.[6] ..... C22C 38/14; C22C 38/00; C22C 38/04

[52] U.S. Cl. ..... 148/337; 148/317; 148/330; 420/87; 420/121; 428/614

[58] Field of Search ..... 148/317, 330, 337; 420/87, 121; C22C 38/14, 38/00; 428/614

[56] References Cited

FOREIGN PATENT DOCUMENTS 4-365835 12/1992 Japan .
4-371548 12/1992 Japan .

OTHER PUBLICATIONS

Zairyoo To Purosesu (Material and Process), vol. 2, 1989, p. 2021.
Bulletin of Japan Institute of Metals, vol. 24, No. 5, 1985, pp. 376–385.
Iron & Steelmaker, vol. 18, No. 2, Feb. 1991, pp. 31–35.

*Primary Examiner*—Melvyn J. Andrews
*Assistant Examiner*—Sean Vincent
*Attorney, Agent, or Firm*—Kenyon & Kenyon

[57] ABSTRACT

An ultralow yield strength steel consisting of: from 0.01 to 0.25 wt % of hexagonal boron nitride particles having an average diameter of from 1 to 30 μm; and the balance consisting of iron and unavoidable impurities.

1 Claim, No Drawings

ULTRALOW YIELD STRENGTH STEEL

BACKGROUND OF THE INVENTION

1. Field of the Invention

The present invention relates to a steel having an ultralow yield strength. A damping structure is necessary to suppress and control the vibration of an architectural structure when subjected to earthquake, wind and other disturbance in order to ensure the safety and comfort of an architectural structure. The steel according to the present invention is very useful in many applications as a structural steel having a high ability to absorb vibration.

2. Description of the Related Art

To provide a low yield strength, attempts have been made to attain a chemical composition as close as possible to that of pure iron, because alloying elements in steel increase the yield strength of the steel. For example, a yield strength of 98 MPa was attained by a sheet product of pure iron (C: 10 ppm, N: 10 ppm, P: 10 ppm, S: 10 ppm) produced by a vacuum refining and casting, as described in "Zairyoo To Purosesu (Material and Process)", vol. 2, 1989, p 2021. To further lower the yield strength, the impurity amount must be minimized. A yield strength of 40 to 50 MPa was attained by a pure iron having a purity of 99.999% or more refined by an ultrahigh vacuum electron beam floating zone melting process, as reported in "Bulletin of the Japan Institute of Metals", vol. 24, No. 5, 1985, p 376–385.

Hexagonal boron nitride particles are introduced into a steel by a process disclosed in Japanese Patent Application No. 3-143602, in which a powder mixture is prepared by mixing a powder of hexagonal boron nitride with an iron powder and is then admixed to a molten steel.

The steel described in "Zairyoo To Purosesu", vol. 2, 1989, p 2021 cannot be used as a structural steel for architectural structures, because the yield strength is not sufficiently low and because the product is in the form of a sheet. Although the steel reported in "Bulletin of the Japan Institute of Metals", vol. 24, No. 5, 1985, pages 376–385 has a sufficiently low yield strength, the use of the ultrahigh vacuum electron beam floating zone melting process not only significantly raises the production cost but also is unsuitable for mass production. The steel disclosed in Japanese Patent Application No. 3-143602 is a free-cutting steel, which is different in application from an ultralow yield strength steel.

SUMMARY OF THE INVENTION

The object of the present invention is to provide an ultralow yield strength steel having a high ability to absorb vibration at a relatively small expense.

The present inventors have found that the yield strength of a steel is lowered by dispersion of hexagonal boron nitride particles in the steel and invented the steels defined in (1), (2) and (3) as follows.

(1) An ultralow yield strength steel consisting of:
- 0.01 to 0.25 wt % of hexagonal boron nitride particles having an average diameter of from 1 to 30 μm; and
- the balance consisting of iron and unavoidable impurities.

(2) An ultralow yield strength steel consisting of:
- 0.01 wt % or less of C;
- 0.10 wt % or less of Si;
- 0.2 wt % or less of Mn;
- 0.05 wt % or less of P;
- 0.05 wt % or less of S;
- 0.05 wt % or less of Al;
- 0.01 wt % or less of soluble N;
- 0.01 to 0.25 wt % of hexagonal boron nitride particles having an average diameter of from 1 to 30 μm; and
- the balance consisting of iron and unavoidable impurities.

(3) An ultralow yield strength steel consisting of:
- 0.01 wt % or less of C;
- 0.10 wt % or less of Si;
- 0.2 wt % or less of Mn;
- 0.05 wt % or less of P;
- 0.05 wt % or less of S;
- 0.05 wt % or less of Al;
- 0.01 to 0.1 wt % of Ti;
- 0.01 wt % or less of soluble N;
- 0.01 to 0.25 wt % of hexagonal boron nitride particles having an average diameter of from 1 to 30 μm; and
- the balance consisting of iron and unavoidable impurities.

DESCRIPTION OF THE PREFERRED EMBODIMENTS

The components of the steel of the present invention have the following effects, respectively.

Carbon (C), when dissolved in steel, remarkably increases the yield strength, and therefore the carbon content must not be more than 0.01 wt %. To lower the yield strength, the carbon content is preferably as small as possible when acceptable from the economical point of view.

Silicon (Si) increases the yield strength, and therefore the silicon content must not be more than 0.1 wt %. To lower the yield strength, the silicon content is preferably as small as possible.

Manganese (Mn) increases the yield strength, and therefore the manganese content must not be more than 0.1 wt %. To lower the yield strength, the manganese content is preferably as small as possible.

Phosphorus (P) not only increases the yield strength but also causes embrittlement, and therefore the phosphorus content must not be more than 0.05 wt %. To lower the yield strength, the phosphorus content is preferably as small as possible.

Sulfur (S) not only increases the yield strength but also causes embrittlement, and therefore the sulfur content must not be more than 0.05 wt %. To lower the yield strength, the sulfur content is preferably as small as possible.

Aluminum (Al) increases the yield strength, and therefore the aluminum content must not be more than 0.05 wt %. To lower the yield strength, the aluminum content is preferably as small as possible.

Soluble nitrogen (sol. N) remarkably increases the yield strength, and therefore the sol. N content must not be more than 0.01 wt %. To lower the yield strength, the sol. N content is preferably as small as possible.

Hexagonal boron nitride (h-BN) is easy to deform in a shear manner, so that particles of h-BN dispersed in a matrix of iron first deform in a shear manner under an externally applied stress as small as several MPa and causes stress concentration at the interface between the iron matrix and the h-BN particles. This stress concentration generates a raised stress greater than the yield strength of the matrix iron, so that the iron matrix subjected to this raised local stress begins to deform in a shear manner even when the applied nominal stress is smaller than the yield strength of the matrix iron. Namely, the steel composed of the iron matrix and the h-BN particles dispersed in the matrix has an effective yield strength smaller than the nominal yield strength of the matrix iron.

This effect is significant when the h-BN content in steel is 0.01 wt % or more and the h-BN particles have an average diameter of 1 μm or more. Either when the h-BN content is more than 0.25 wt % or when the h-BN particles have an average diameter of greater than 30 μm, the elongation of the steel becomes too small to be acceptable for structural use. Therefore, the h-BN content in steel must be within the range of from 0.01 to 0.25 wt % and the h-BN particles must have an average diameter within the range of from 1 to 30 μm.

The h-BN content can be determined from the area fraction of h-BN particles observed in a cross-section of the steel, as expressed by the following formula (1):

$$[\text{h-BN content}](\text{wt }\%) = (2.34/7.86) \times [\text{h-BN area fraction}] \quad (1)$$

The average diameter of h-BN particles is defined by the average cross-sectional area of h-BN particles observed in a cross section of the steel, as expressed by the following formulae (2) and (3):

$$[\text{h-BN average diameter}](\mu\text{m}) = \text{square root of } [\text{h-BN average cross-sectional area in } \mu\text{m}^2] \quad (2)$$

$$[\text{h-BN average cross-sectional area}] = [\text{total area observed}] \times [\text{h-BN cross-sectional area}] \div [\text{total number of h-BN particles}] \quad (3)$$

where [h-BN cross-sectional area]is determined based on JIS G 0555 and has the same value as that of the JIS G 0555 index of cleanliness of the steel regarding the h-BN "non-metallic inclusion".

Titanium (Ti) fixes solute C and N by forming TiC and TiN, thereby reducing the contents of solute C and N, and consequently lowers the yield strength. This effect is significant when Ti is present in an amount of 0.01 wt % or more. A Ti content of more than 0.1 wt %, however, causes coarsening of TiC and TiN and the resulting reduction of the elongation to a level not acceptable in structural use. Therefore, the Ti content must be within the range of from 0.01 to 0.1 wt %. Ti may be added, when necessary.

EXAMPLE

Steels according to the present invention were produced by preparing a steel melt in an induction furnace, adding a deoxidizer-Al to the melt, then immediately introducing into the melt an iron pipe enclosing a powder mixture of h-BN and iron, and then tapping the melt one and a half minutes after the powder introduction. The steels were cast in 50-kg ingots having compositions shown in Tables 1 and 2. The ingots were heated at 1200° C., hot-rolled to 50 mm thick plates, and subjected to a normalizing heat treatment at 900° C. for 1 hour followed by air-cooling to room temperature.

To determine the yield strength of the steel plates, JIS No. 4 tensile test specimens were taken in the C-direction from the ¼ thickness portion of the plates. The tensile test data are summarized in Table 2.

Steels 1 to 15 according to the present invention had an ultralow yield strength of less than 90 MPa. Comparison among the present inventive steels 12, 13, and 14 shows that the more the h-BN content, the lower the yield strength. Comparison between steels 12 and 15 also shows that the Ti addition further reduces the yield strength.

Comparative steels 16 to 26, having chemical compositions and/or h-BN average diameters outside the claimed ranges, had yield strengths greater than those of inventive steels 1 to 15.

Comparative steel 22 having an excessive amount of h-BN and comparative steel 24 having an h-BN average diameter greater than 30 μm both had a yield strength of greater than 100 MPa and a very low elongation.

TABLE 1

| Steels | | Chemical Compositions of Steels (wt %) | | | | | | |
|---|---|---|---|---|---|---|---|---|
| | | C | Si | Mn | P | S | Al | sol. N |
| Invention | 1 | 0.009 | 0.028 | 0.180 | 0.003 | 0.002 | 0.028 | 0.009 |
| | 2 | 0.005 | 0.059 | 0.150 | 0.008 | 0.003 | 0.049 | 0.004 |
| | 3 | 0.001 | 0.081 | 0.149 | 0.007 | 0.005 | 0.042 | 0.003 |
| | 4 | 0.005 | 0.028 | 0.127 | 0.007 | 0.005 | 0.022 | 0.002 |
| | 5 | 0.008 | 0.097 | 0.151 | 0.008 | 0.004 | 0.025 | 0.002 |
| | 6 | 0.001 | 0.073 | 0.122 | 0.009 | 0.044 | 0.016 | 0.008 |
| | 7 | 0.001 | 0.042 | 0.165 | 0.042 | 0.002 | 0.002 | 0.008 |
| | 8 | 0.002 | 0.057 | 0.117 | 0.022 | 0.003 | 0.022 | 0.005 |
| | 9 | 0.004 | 0.069 | 0.192 | 0.007 | 0.005 | 0.045 | 0.004 |
| | 10 | 0.008 | 0.078 | 0.166 | 0.009 | 0.005 | 0.032 | 0.005 |
| | 11 | 0.009 | 0.036 | 0.197 | 0.008 | 0.005 | 0.035 | 0.004 |
| | 12 | 0.005 | 0.048 | 0.060 | 0.006 | 0.004 | 0.009 | 0.006 |
| | 13 | 0.005 | 0.049 | 0.056 | 0.005 | 0.004 | 0.010 | 0.006 |
| | 14 | 0.005 | 0.049 | 0.057 | 0.005 | 0.004 | 0.009 | 0.006 |
| | 15 | 0.005 | 0.047 | 0.060 | 0.005 | 0.004 | 0.009 | 0.007 |
| Comparison | 16 | *0.012 | 0.100 | 0.155 | 0.014 | 0.005 | 0.025 | 0.004 |
| | 17 | 0.005 | *0.110 | 0.164 | 0.006 | 0.005 | 0.026 | 0.006 |
| | 18 | 0.008 | 0.057 | *0.234 | 0.048 | 0.003 | 0.033 | 0.009 |
| | 19 | 0.001 | 0.069 | 0.137 | *0.068 | *0.055 | 0.044 | 0.009 |
| | 20 | 0.001 | 0.078 | 0.195 | 0.005 | 0.006 | *0.061 | 0.008 |
| | 21 | 0.002 | 0.087 | 0.176 | 0.004 | 0.004 | 0.021 | *0.020 |
| | 22 | 0.004 | 0.048 | 0.197 | 0.004 | 0.011 | 0.022 | 0.005 |
| | 23 | 0.008 | 0.099 | 0.060 | 0.006 | 0.013 | 0.023 | 0.004 |
| | 24 | 0.009 | 0.049 | 0.056 | 0.008 | 0.005 | 0.024 | 0.005 |
| | 25 | 0.005 | 0.057 | 0.057 | 0.007 | 0.004 | 0.026 | 0.006 |
| | 26 | 0.010 | 0.044 | 0.114 | 0.008 | 0.003 | 0.024 | 0.008 |

(Asterisked data are outside the present inventive range.)

TABLE 2

| Steels | | h-BN content (wt %) | h-BN ave. dia. (μm) | Ti (wt %) | Y.P. (MPa) | Elongation (%) |
|---|---|---|---|---|---|---|
| Invention | 1 | 0.135 | 28 | — | 88 | 61 |
| | 2 | 0.125 | 12 | — | 81 | 63 |
| | 3 | 0.144 | 18 | 0.011 | 79 | 58 |
| | 4 | 0.051 | 15 | 0.012 | 85 | 58 |
| | 5 | 0.201 | 5 | 0.045 | 65 | 66 |
| | 6 | 0.177 | 7 | 0.097 | 78 | 57 |
| | 7 | 0.133 | 8 | 0.033 | 86 | 55 |
| | 8 | 0.100 | 4 | 0.034 | 85 | 55 |
| | 9 | 0.039 | 1 | 0.025 | 77 | 55 |
| | 10 | 0.041 | 9 | 0.026 | 79 | 60 |
| | 11 | 0.099 | 10 | 0.074 | 82 | 61 |
| | 12 | 0.019 | 8 | — | 89 | 61 |
| | 13 | 0.080 | 8 | — | 75 | 63 |
| | 14 | 0.233 | 8 | — | 54 | 54 |
| | 15 | 0.020 | 8 | 0.051 | 78 | 64 |
| Comparison | 16 | 0.144 | 7 | 0.065 | 102 | 45 |
| | 17 | 0.104 | 6 | 0.043 | 97 | 60 |
| | 18 | 0.131 | 7 | 0.055 | 115 | 45 |
| | 19 | 0.045 | 7 | 0.045 | 121 | 53 |
| | 20 | 0.133 | 12 | — | 122 | 60 |
| | 21 | 0.154 | 15 | — | 105 | 61 |
| | 22 | *0.28 | 15 | — | 105 | 30 |
| | 23 | *0.008 | 14 | — | 160 | 58 |
| | 24 | 0.124 | *45 | — | 123 | 21 |

TABLE 2-continued

| Steels | | h-BN content (wt %) | h-BN ave. dia. (μm) | Ti (wt %) | Y.P. (MPa) | Elongation (%) |
|---|---|---|---|---|---|---|
| | 25 | 0.135 | *0.8 | — | 134 | 55 |
| | 26 | 0.150 | 13 | *0.150 | 118 | 59 |

(Asterisked data are outside the present inventive range.)

As described herein above, the present invention provides a steel having an ultralow yield strength. The present inventive steel is applicable as a structural steel exhibiting a very high ability to absorb vibration, and accordingly, is very useful in many industrial fields, particularly for architectural use.

We claim:

1. An ultralow yield strength steel consisting of:

0.01 wt % or less of C;

0.10 wt % or less of Si;

0.2 wt % or less of Mn;

0.05 wt % or less of P;

0.05 wt % or less of S;

0.05 wt % or less of Al;

0.01 to 0.1 wt % of Ti;

0.01 wt % or less of soluble N;

0.01 to 0.25 wt % of hexagonal boron nitride particles having an average diameter of from 1 to 30 μm; and the balance consisting of iron and unavoidable impurities.

* * * * *